United States Patent [19]

Acree

[11] Patent Number: 4,799,552

[45] Date of Patent: Jan. 24, 1989

[54] METHOD AND APPARATUS FOR INJECTING RADIOACTIVE TAGGED SAND INTO OIL AND GAS WELLS

[75] Inventor: Elick H. Acree, Webster, Tex.

[73] Assignee: Gulf Nuclear, Inc., Webster, Tex.

[21] Appl. No.: 71,402

[22] Filed: Jul. 9, 1987

[51] Int. Cl.[4] ..... E21B 43/00; G01V 5/00

[52] U.S. Cl. ..... 166/305.1; 166/250; 166/75.1; 250/260; 137/268

[58] Field of Search ..... 166/250, 75.1, 70, 247, 166/280, 308, 305.1; 250/259, 260, 432 R; 137/268; 222/389; 414/217

[56] References Cited

U.S. PATENT DOCUMENTS

| | | | |
|---|---|---|---|
| 2,989,631 | 6/1961 | Bohn | 250/43.5 |
| 3,010,023 | 11/1961 | Egan et al. | 250/260 |
| 3,251,993 | 5/1966 | Bader et al. | 250/260 |
| 3,402,769 | 9/1968 | Doggett et al. | 166/4 |
| 3,472,285 | 10/1969 | Ginsburgh et al. | 138/97 |
| 3,815,681 | 6/1974 | Richardson | 166/281 |
| 4,132,243 | 1/1979 | Kuus | 137/268 |
| 4,199,680 | 4/1980 | Moon | 250/260 |
| 4,574,880 | 3/1986 | Handke | 166/75.1 |
| 4,659,925 | 4/1987 | Burbidge et al. | 250/260 |
| 4,681,245 | 7/1987 | Harvey | 222/410 |

*Primary Examiner*—George A. Suchfield
*Assistant Examiner*—Bruce M. Kisliuk
*Attorney, Agent, or Firm*—Ben D. Tobor

[57] ABSTRACT

A method and apparatus for injecting radioactive tagged sand into fluids used in hydraulic well fracturing, or acidizing, operations, the fluids being pumped under high pressure into the well bore by a high pressure pump, wherein the radioactive tagged sand does not contaminate the high pressure pump, and the pressure between the high pressure fracturing fluids and/or acidizing fluids and the radioactive tagged sand is equalized, whereby it is not necessary to overcome the high pressure present in the system.

5 Claims, 3 Drawing Sheets

Fig. 1
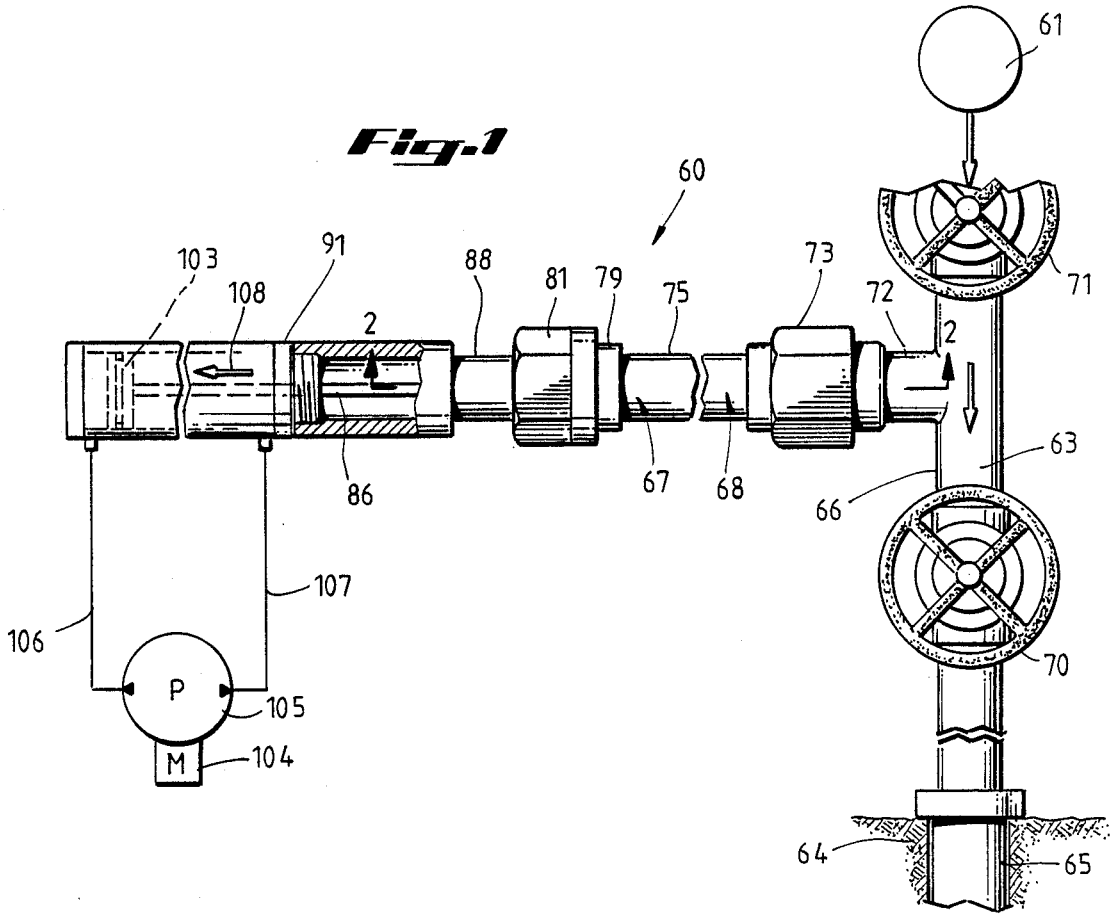
Fig. 3
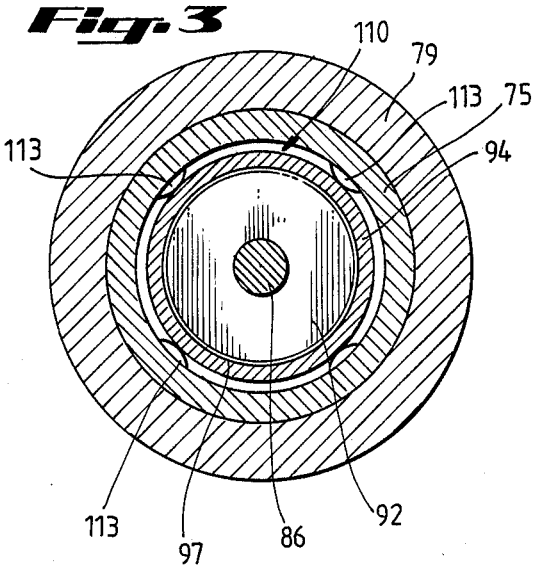
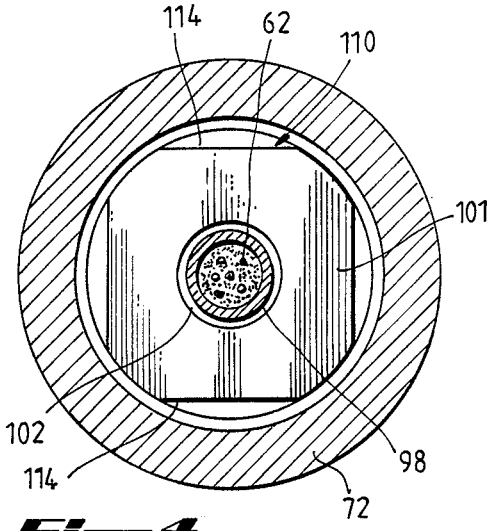
Fig. 4

METHOD AND APPARATUS FOR INJECTING RADIOACTIVE TAGGED SAND INTO OIL AND GAS WELLS

FIELD OF THE INVENTION

The invention relates to a method and apparatus for injecting radioactive tagged sand into fluids used in hydraulic well fracturing, or acidizing, operations of an earthen formation penetrated by a well bore.

DESCRIPTION OF THE PRIOR ART

In acidizing, or fracturing, an oil or gas well, large volume, high pressure pumps are typically used to inject a treatment solution into a flow line, or piping, leading to the wellhead, which in turn leads to the well bore. The solution, or fracturing fluid, is generally chemicals mixed in water or gel-water and sand. The sand acts as a propping agent, such that when the pressure opens up the earthen formation, or strata, the sand keeps the formation open.

Well-logging operations may be conducted to determine the effectiveness and necessity of stimulating the well with fracturing materials and/or acid materials to stimulate the flow of fluid from the well. The well-logging operations can help determine information such as: the fracture location with respect to depth; the type of fracture produced; the number of fractures produced, an estimate of fracture thickness; and the effectiveness of the fracturing and/or acidizing method used. In order to conduct such well-logging operations, it is necessary to inject radioactive tagged sand into the well-bore along with the fracturing fluid.

Heretofore, the radioactive tagged sand was mixed in a conventional mixing blender which mixes the fracturing fluid and flows into the lower pressure side of the high pressure pump, which pumps the fracturing fluid into the well bore. The use of the radioactive tagged material in the mixing blender and high pressure pump, thus causes contamination of the mixing blender, high pressure pump, and other related equipment, whereby such equipment cannot be used for pumping other materials. If a sufficient quantity of the radioactive tagged sand remains in the high pressure pump and related equipment, such equipment may have to be removed from further service. Additionally, such equipment can become radioactively "hot" ausing significant safety problems around the well site, as well as can cause problems with determining how much radioactive material has been placed in the well. Failure to accurately determine how much radioactive tagging material has been placed in the well can affect the accuracy of the results obtained from the well-logging operations.

In addition to the contamination problems previously described, present methods and apparatus for the injection of radioactive tagged sand into oil and/or gas wells have other problems associated with the high working pressures which can be encountered in the piping leading to the well bore, which pressures may be as high as 10,000 psi. Additionally, the sand, which has been radioactively tagged is naturally abrasive and is difficult to pump.

Accordingly, prior to the development of the present invention, there has been no method and apparatus for injecting radioactive tagged sand into fluids used in hydraulic well fracturing, or acidizing, operations which: does not involve contamination of the high pressure pumps and related equipment; readily overcomes the high working pressure in the piping leading to the well bore; and minimizes the effects of the abrasiveness of the material which is radioactively tagged. Therefore, the art has sought a method and apparatus for injecting radioactive tagged sand into fluids used in hydraulic well fracturing, or acidizing, operations wherein: contamination of the high pressure pumps and related equipments is avoided; the radioactive tagged sand may be readily injected into the piping which contains a high working pressure; and the effects of the abrasiveness of the sand material which has been radioactively tagged is minimized.

SUMMARY OF THE INVENTION

In accordance with the invention, the foregoing advantages have been achieved through the present injection system for injecting radioactive tagged sand into fluids used in hydraulic well fracturing, or acidizing, operations of an earthen formation penetrated by a well bore, the fluid being pumped under high pressure through piping into the well bore and earthen formation by a high pressure pump located on the surface of the earth. The present invention includes means for forcing the radioactive tagged sand into the piping, the forcing means being disposed between the well bore and the high pressure pump, the forcing means including means for containing the radioactive tagged sand; and means for equalizing the pressure between the piping, the forcing means, and the container means, whereby the radioactive tagged sand may be readily injected into the fluids in the piping without the necessity of overcoming the high pressure present in the piping, and the radioactive tagged sand will not contaminate the high pressure pump.

A feature of the present invention is that the forcing means may include a piston having a force transmitting surface in contact with the radioactive tagged sand and the container means may include a mating cylinder having open ends, the first end in communication with the piping and the second end receiving the force transmitting surface of the piston of the forcing means. A further feature of the present invention is that the pressure equalizing means may include at least one flow path in communication between the piping and the surface of the piston which is not in contact with the radioactive tagged sand, whereby the pressure acting on the first and second ends of the container means is substantially the same.

Another feature of the present invention is that the forcing means and container means may be disposed within a housing and the at least one flow path is disposed between the housing and the cylinder.

In accordance with the invention, the foregoing advantages have also been achieved through the present method for injecting radioactive tagged sand into fluids used in a hydraulic well fracturing, or acidizing, operation of an earthen formation penetrated by a well bore, the fluid being pumped under high pressure through piping into the well bore and earthen formation by a high pressure pump located on the surface of the earth. The method of the present invention includes the steps of: forcing the radioactive tagged sand from a means for containing the radioactive tagged sand, which is disposed between the well bore and the high pressure pump, into the piping; and equalizing the pressure between the piping and the container means, whereby the radioactive tagged sand may be readily injected into the fluids in the piping without the necessity of overcoming the high pressure present in the piping, and the radioactive tagged sand will not contaminate the high pressure pump.

Another feature of the method of the present invention is that the radioactive tagged sand may be suspended in a gel, whereby the sand may be easily forced from the container means into the piping.

Another feature of the present invention is that the pressure may be equalized between the piping and the container means by disposing at least one flow path in communication between the piping and the container means, whereby the pressure acting on the radioactive tagged sand in the container means is substantially the same as the pressure present in the piping.

An additional feature of the present invention is that a radioactive tagging material may be placed in the gel, whereby the path of the gel may be determined.

The method and apparatus for injecting radioactive tagged sand into fluids used in hydraulic well fracturing, or acidizing, operations of an earthen formation, when compared with previously proposed prior art methods and apparatus, have the advantages of: eliminating radioactive contamination of the high pressure pump and related equipment, readily overcome the high working pressure present in the piping leading to the well bore; and minimize the effects of the abrasiveness of the sand which has been radioactively tagged.

BRIEF DESCRIPTION OF THE DRAWINGS

In the drawings:

FIG. 1 is a partial cross-sectional view along the longitudinal axis of an injection system in accordance with the present invention;

FIG. 3 is a cross-sectional view of the injection system taken along line 3—3 of FIG. 2;

FIG. 4 is a partial cross-sectional view of the injection system taken along line 4—4 of FIG. 2.

While the invention will be described in connection with the preferred embodiment, it will be understood that it not intended to limit the invention to that embodiment. On the contrary, it is intended to cover all alternatives, applications, and equivalents as may be included within the spirit and scope of the invention as defined by the appended claims.

DETAILED DESCRIPTION OF THE INVENTION

Figure 2:
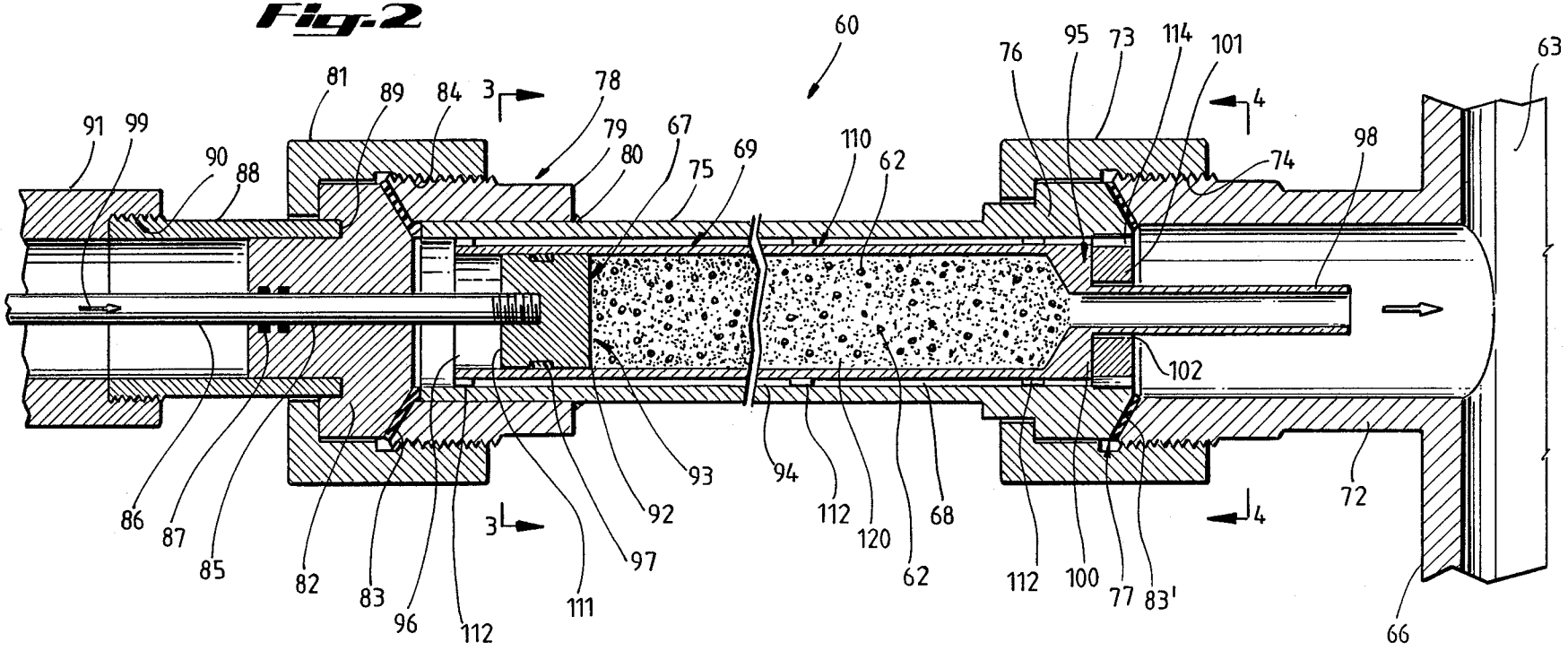
FIG. 2 is a cross-sectional view of the injection system taken along line 2—2 of FIG. 1.

In FIGS. 1 and 2, an injection system 60 for injecting radioactive tagged sand 62 into fluids 63 used in hydraulic well fracturing, or acidizing operations of an earthen formation 64 penetrated by a well bore 65, the fluid 63 being pumped under high pressure through piping 66 into the well bore 65 and earthen formation 64 by a high pressure pump 61 located on the surface of the earth. The injection system 60 is shown to comprise a means for forcing 67 radioactive tagged sand 62 into piping 66, the forcing means 67 being disposed between the well bore 65 and the high pressure pump 61. The forcing means 67 may further include means for containing 68 the radioactive tagged sand 62. As will be further described in greater detail, the injection system 60 includes a means for equalizing 69 the pressure between the piping 66, the forcing means 67, and the container means 68, whereby the radioactive tagged sand 62 may be readily injected into the fracturing fluid 63 flowing through the piping 66, without the necessity of overcoming the high pressure typically present in the piping 66, and the radioactive tagged sand 62 will not contaminate the high pressure pump 61.

Still with reference to FIGS. 1 and 2, piping 66 is a conventional flowline disposed between high pressure pump 61 and the well bore 65, and may be provided with conventional valves, such as gate valves 70, 71. Piping 66 is also preferably provided with a tee fitting 72 which permits the injection system 60 to be threadedly connected to piping, or flowline, 66 in a conventional manner as by nut 73 which threadedly mates with the threaded end 74 of tee 72, in a conventional manner. It should of course be readily understood by one of ordinary skill in the art that any other suitable, conventional methods and/or components could be utilized to attach injection system 60 to piping 66, provided such connection has the requisite strength and sealing characteristics to provide a fluid and pressure tight connection between injection system 60 and piping 66. In this regard, the working pressure of high pressure pump 61 used for injecting the fracturing fluid, or acid materials, 63 into well bore 65 can be as high as 10,000 psi.

With reference to FIGS. 1 and 2, injection system 60 may include a housing 75 which may be formed of conventional high pressure tubing having an outwardly extending annular flange portion 76 at one end 77, which cooperates with nut 73 in the manner previously described. Flange portion 76 may be integral with the tubing of housing 75 a shown in FIGS. 1 and 2, or alternatively flange portion 76 may be a separate piece and welded to end 77 of housing 75. Housing 75 at its other end 78 may include a threaded annular flange member 79 which may be fixedly secured to housing 75, as by welding 80. Threaded flange member 79 in turn may be threadedly received by nut 81 in a manner similar to the connection between nut 73 and tee fitting 72. Nut 81 serves to hold a pressure barrier member 82 in a sealing relationship with housing 75 and threaded flange member 79. A suitable seal, or gasket, 83 may be disposed between pressure barrier member 82 and the threaded end 84 of threaded flange member 79. Thus, upon tightening nut 81 upon threaded flange member 79, pressure barrier member 82 is forced into a sealing relationship against housing 75 and threaded flange member 79. Likewise, a suitable seal, or gasket, 83' may be disposed between the threaded end 74 of tee fitting 72 and the flange member 76 of housing 75, whereby housing 75 is forced into a sealing, abutting relationship with the tee fitting 72, upon tightening down of nut 73 upon the threaded end 74 of tee fitting 72.

Pressure barrier member 82 preferably has a cylindrical opening 85 extending therethrough for passage for a piston rod, or shaft, 86 associated with forcing means 67 as will be hereinafter described in further detail. Conventional O-ring seals, or other suitable packings, 87 are associated with passageway 85 to provide a pressure tight seal about piston shaft 86. Further, another section of high pressure tubing 88, such as that used for housing 75, may be fixedly secured to pressure barrier member 82 as by welding tubing 88 into an annular grove 89 formed in pressure barrier member 82. The other end 90 of tubing 88 may preferably be threaded for receipt into a hydraulic ram 91 which will be hereinafter described in greater detail.

With reference now to FIGS. 2–5, it is seen that forcing means 67 may preferably include a piston 92 having a force transmitting surface 93 in contact with the radioactive tagged sand 62; the piston 92 being sealingly received within container means 68. Container means 68 may preferably be a cylindrical member 94 having open ends 95, 96, the first end 95 being in fluid communication with piping 66, in a manner to be hereinafter described in greater detail, and the second open end 96 receiving the force transmitting surface 93 of the piston 92 of forcing means 67. Piston 92 is preferably provided with conventional O-rings, or other packing, 97, whereby piston 92 is sealingly received within cylinder 94. Accordingly, upon application of a longitudinal force upon piston 92, such as from piston rod, or shaft, 86, such force is transmitted by the force transmitting surface 93 of piston 92 to the radioactive tagged sand 62, which sand 62 is forced outwardly of the first end 95 of cylinder 94 into the tee fitting 72 and hence into piping 66.

Figure 5:
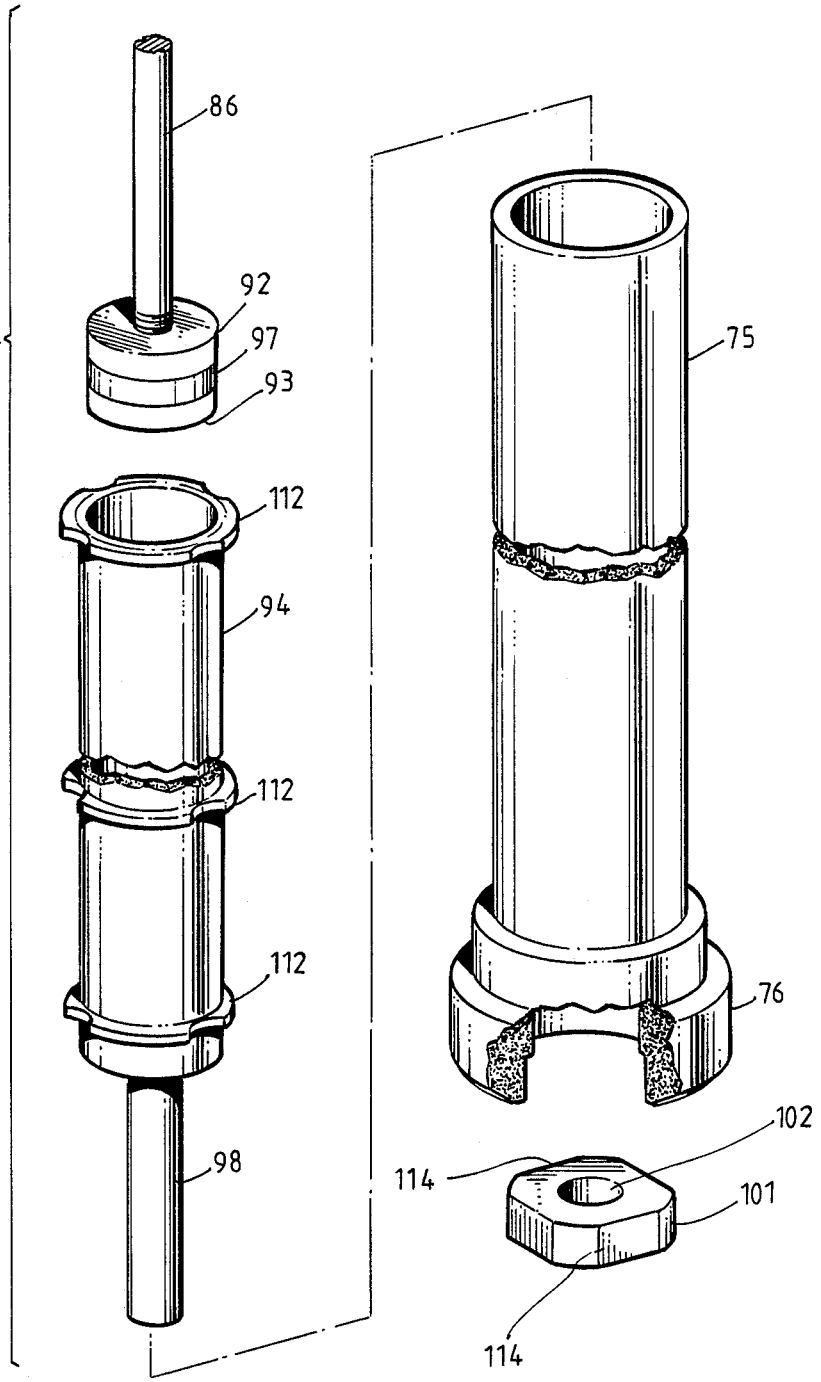
FIG. 5 is an exploded view of a portion of the injection system of FIGS. 1 and 2.

As seen in FIGS. 2, 4 and 5, container means 68 may include an elongate nozzle portion 98 which extends into tee fitting 72. Longitudinal movement of cylinder 94 of container means 68 upon longitudinal movement of piston 92 in the direction of arrow 99, is restrained by an end wall 100 of cylinder 94 abutting against an abutment member 101 fixedly secured to the end of housing 75, as by welding abutment member 101 within housing 75. Abutment member 101 includes a passageway 102 through which nozzle portion 98 of cylinder 94 may pass.

With reference to FIG. 1, longitudinal movement of piston rod, or shaft, 86, which moves piston 92 of forcing means 67, may be provided by a conventional hydraulic ram 91 which contains a piston 103. The movement of piston 103 controls the movement of piston rod, or shaft, 86 in a conventional manner. Hydraulic ram 91 preferably includes a motor 104 which operates a conventional hydraulic pump 105. A suitable, conventional valve (not shown) may be used to control the passage of hydraulic fluid from pump 105 into either hydraulic lines 106, 107. Pumping of hydraulic fluid into hydraulic line 106 and hence into hydraulic ram 91 would result in movement of piston rod, or shaft, 86 in the direction of arrow 99 (FIG. 2), in a conventional manner. Likewise, pumping of hydraulic fluid into hydraulic line 107 would cause piston 103, and in turn piston rod, or shaft 86, to be moved in the direction of arrow 108, in a conventional manner.

Were the working pressure in piping 66 to be on the order of the high pressure produced by high pressure pump 61, it would typically be necessary for hydraulic ram 91 to generate a pressure force greater than the working pressure found in piping 66, in order for forcing means 67 to force the radioactive tagged sand 62 into piping 66. The high working pressure would be acting upon the radioactive tagged sand 62, as by acting upon the radioactive tagged sand 62 through nozzle 98. In order to eliminate the necessity of overcoming the high working pressure found within piping 66, the pressure between the piping 66, the forcing means 67, and the container means 68 is equalized by pressure equalizing means 69. As shown in FIGS. 2–5, pressure equalizing means 69 preferably includes at least one flow path 110 in communication between the piping 66 and the rear surface 111 of piston 92 which is not in contact with the radioactive tagged sand 62. Accordingly, the pressure from piping 66 acting upon the first end 95 of cylinder 94 of container means 68 is substantially the same as the pressure acting upon the second end 96 of cylinder 94. As previously described, container means 68 for radioactive tagged sand 62 is disposed within the pressure tight housing 75 and the at least one flow path 110 may be disposed between the housing 75 and the cylinder 94 of container means 68. The requisite flow path 110 of pressure equalizing means 69 can be provided by disposing cylinder 94 of container means 68 within housing 75 in a slightly spaced, unsealed relationship, as by merely sliding cylinder 94 into housing 75. For typical high pressures encountered in piping 66, a very small clearance between housing 75 and cylinder 94 is all that is necessary to provide the requisite flow path 110. Alternatively, cylinder 94 of container means 68 may be supported within the housing 75 as by at least one spider assembly 112, whereby the at least one flow path 110 is provided between the housing 75 and the cylinder 94 of container means 68. As shown in FIG. 5 three spider assemblies 112 may be used. Alternatively, the spider assembly 112 could be merely be a plurality of spacing members 113 (FIG. 3) circumferentially spaced about the interior of housing 75, whereby the requisite flow path 110 is provided between housing 75 and cylinder 94. It should be noted that abutment member 101 is provided with a plurality of flats 114 whereby the pressurized fluids 63 may pass to the backside 111 of piston 92 whereby the pressure is equalized in the desired manner. Accordingly, hydraulic ram 91 need only exert enough force upon piston 92 to force the radioactive tagged sand 62 outwardly of container means 68 through nozzle 98 into piping 66, without the necessity of overcoming the high working pressure contained in piping 66.

With reference to FIGS. 1 and 2, the method of the present invention for injecting radioactive tagged sand 62 into fluids 63 used in a hydraulic well fracturing or acidizing operation of an earthen formation 64 penetrated by a well bore 65, wherein the fluid 63 is being pumped under high pressure through piping 66 into the well bore 65 and earthen formation 64 by a high pressure 61 located on the surface of the earth will be described. The radioactive tagged sand 62 is forced from a means for containing 68 the radioactive tagged sand 62 into the piping 66, and the container means 68 is disposed between the well bore 65 and the high pressure pump 61. The pressure is equalized between the piping 66 and the container means 68, whereby the radioactive tagged sand 62 may be readily injected into the fluids 63 in the piping 66 without the necessity of overcoming the high pressure present in the piping 66 and the radioactive tagged sand 62 will not contaminate the high pressure pump 61 and related mixing and/or blending equipment.

Because the sand which is treated to become the radioactive tagged sand 62 contained in cylinder 94 is typically quite abrasive, this property of the sand 62 greatly increases the difficulty of forcing the sand 62 out of container means 68. The abrasive nature of the sand 62 can decrease the working life of piston 92 and cylinder 94. In order to minimize the harm done by the abrasive nature of the sand 62, the radioactive tagged sand 62 may be suspended within a suitable gel material 120, which gel servies to lubricate the radioactive tagged sand 62, whereby the radioactive tagged sand 62 suspended in gel 120 may be easily forced from the cylinder 94 into piping 66. The suspension of sand 62 in gel 120 further serves to minimize the sand from abrading the interior surface of cylinder 94 and/or damaging the exterior surface of piston 92 and/or its seals 97. Pressure may be equalized between the piping 66 and the container means 68 as by disposing at least one flow path 110 in fluid communication between the piping 66 and the container means 68, in either manner previously described, whereby the pressure acting on the radioactive tagged sand 62 in container means 68 is substantially the same as the pressure present in piping 66. If desired, an additional radioactive tagging material, different from that used to radioactively tag sand 62, may be placed in the gel 120. By using conventional well-logging techniques, the disposition of the radioactive tagged gel may be logged, as well as the disposition of the radioactive tagged sand 62.

It shall of course be readily apparent to one of ordinary skill in the art, that all of the previously described components of injection system 60 may be made of any suitable material having the requisite strength characteristics for use under high pressure operating conditions, as well as having suitable corrosion resistance characteristics to withstand contact with the fracturing, or acidizing, fluids 63 utilized in piping 66. Furthermore, although many of the components are illustrated as having a cylindrical cross-sectional configuration, such as housing 75, cylinder 94, tubing 88, piston 92, it should be readily apparent to of ordinary skill in the art, that such components could have other cross-sectional configurations. The primary considerations are that forcing means 67 is received within container means 68 in a sealing and mating relationship, and that the desired at least flow path 110 be provided to equalize the pressure in the manner previously described.

It is to be understood that the invention is not limited to exact details of construction, operation, exact materials or embodiments shown and described, as obvious modifications and equivalents will be apparent to one skilled in the art; for example, a flow path could be provided through the container means and through its mating forcing means, whereby pressurized fluid from piping 66 could act upon the back surface of the forcing means 67. Accordingly, the invention is therefore to be limited only by the scope of the appended claims.

I claim:

1. An injection system for injecting radioactive tagged sand into fluids used in hydrualic well fracturing, or acidizing, operations of an earthen formation penetrated by a well bore, the fluid being pumped under pressure through piping into the well bore and earthen formation by a high pressure pump located on the surface of the earth, comprising:

means for forcing the radioactive tagged sand into the piping, the forcing means being disposed between the well bore and the high pressure pump, the forcing means including means for containing the radioactive tagged sand, wherein the forcing means includes a piston having a force transmitting surface in contact with the radioactive tagged sand, and the container means includes a mating cylinder having open ends, with a first end in communication with the piping and a second end receiving the force transmitting surface of the piston of the forcing means;

the forcing means and container means are disposed within a housing;

means for equalizing the pressure between the piping, the forcing means, and the container means, wherein the pressure equalizing means includes at least one flow path in communication between the piping and surface of the piston which is not in contact with the radioactive tagged sand, and the at least one flow path is disposed between the housing and the cylinder of the container means, whereby the radioactive tagged sand may be readily injected into the fluids in the piping without the necessity of overcoming the high pressure present in the piping, and the radioactive tagged sand will not contaminate the high pressure pump.

2. The injection system of claim 1, wherein the container means is supported within the housing by at least one spider assembly whereby the at least one flow path is provided between the housing and the cylinder of the container means.

3. A method for injecting radioactive tagged sand into fluids used in hydraulic well fracturing, or acidizing, operations of an earthen formation penetrated by a well bore, the fluid being pumped under pressure through piping into the well bore and earthen formation by a high pressure pump located on the surface of the earth, comprising the steps of:

forcing the radioactive tagged sand from a means for containing the radioactive tagged sand, which is disposed between the well bore and the high pressure pump, into the piping;

suspending the radioactive tagged sand in a gel, whereby the sand may be easily forced from the container means into the piping; and equalizing the pressure between the piping and the container means, whereby the radioactive sand may be readily injected into the fluids in the piping without the necessity of overcoming the pressure present in the piping, and the radioactive tagged sand will not contaminate the high pressure pump.

4. The method of claim 3, wherein the pressure in the piping is equalized between the piping and the container means by disposing at least one flow path in fluid communciation between the piping and the container means whereby the pressure acting on the radioactive tagged sand in the container means is substantially the same as the pressure present in the piping.

5. The method of claim 3, further including the steps of placing a radioactive tagging material in the gel, whereby the path of the gel may be determined.

* * * * *